US008404425B2

(12) United States Patent
Maekawa et al.

(10) Patent No.: US 8,404,425 B2
(45) Date of Patent: Mar. 26, 2013

(54) APPARATUS AND METHOD FOR MANUFACTURING TONER

(75) Inventors: Yoichi Maekawa, Shizuoka-ken (JP); Tomoyuki Satoh, Yokosuka (JP); Hideyuki Santo, Numazu (JP); Kazunobu Muramatsu, Fuji (JP)

(73) Assignee: Ricoh Company, Limited, Tokyo (JP)

( * ) Notice: Subject to any disclaimer, the term of this patent is extended or adjusted under 35 U.S.C. 154(b) by 558 days.

(21) Appl. No.: 12/683,616

(22) Filed: Jan. 7, 2010

(65) Prior Publication Data

US 2010/0173243 A1 Jul. 8, 2010

(30) Foreign Application Priority Data

Jan. 7, 2009 (JP) ..... 2009-001429

(51) Int. Cl.
*G03G 5/00* (2006.01)

(52) U.S. Cl. ..... 430/137.2; 241/24.1; 241/81

(58) Field of Classification Search ..... 430/137.2; 241/24.1, 81
See application file for complete search history.

(56) References Cited

U.S. PATENT DOCUMENTS

| | | | | |
|---|---|---|---|---|
| 4,163,649 | A * | 8/1979 | Calvert | 95/275 |
| 4,782,001 | A * | 11/1988 | Kanda et al. | 430/137.21 |
| 2008/0227021 | A1 | 9/2008 | Suganuma | |

FOREIGN PATENT DOCUMENTS

| | | |
|---|---|---|
| JP | 2004-57843 | 2/2004 |
| JP | 3870032 | 10/2006 |
| JP | 2007-178718 | 7/2007 |
| JP | 2008-225317 | 9/2008 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

An apparatus for manufacturing toner is provided which includes a pulverizer for pulverizing a material into particles, a classifier for classifying the particles by size, a discharging path for discharging the particles from the pulverizer to the classifier, a returning path for returning relatively coarse particles among the classified particles from the classifier to the pulverizer, and a handling unit for handling particles. A method for manufacturing toner is also provided which includes pulverizing a material into particles in a pulverizer, discharging the particles from the pulverizer to a classifier via a discharging path, classifying the particles by size in the classifier, and returning relatively coarse particles among the classified particles from the classifier to the pulverizer. The handling unit is provided on at least one of the discharging path and the returning path, and includes a mechanism for preventing accumulation of the particles using airflow.

10 Claims, 1 Drawing Sheet

APPARATUS AND METHOD FOR MANUFACTURING TONER

BACKGROUND OF THE INVENTION

1. Field of the Invention

The present invention relates to an apparatus and a method for manufacturing toner for use in image forming methods such as electrophotography, electrostatic recording, electrostatic printing, and toner jet recording.

2. Discussion of the Background

Methods of manufacturing toner are broadly divided into pulverization methods and polymerization methods. A typical pulverization method includes a process of pulverizing a kneaded mixture of toner components into toner particles. Pulverization methods are advantageous from the viewpoint of cost. Therefore, toners manufactured by pulverization methods have been widely used for copiers and printers.

More specifically, a typical pulverization method includes processes of mixing, melt-kneading, pulverization, classification, and external treatment. In the mixing process, a binder resin and a colorant, optionally along with a charge controlling agent, a magnetic material, a release agent, and/or a fluidizer, are mixed. The resulting mixture is melted and kneaded in the melt-kneading process, followed by cooling to solidify. The kneaded mixture is pulverized into particles by a pulverizer in the pulverization process. The particles are then classified by size to collect desired-size particles in the classification process. The desired-size particles are mixed with a fluidizer in the external treatment process. Thus, a toner for forming images can be produced.

When the toner thus prepared is used for two-component developing methods, the toner is mixed with a magnetic carrier.

Specific examples of the above pulverizer include collision-type airflow pulverizers and opposed airflow pulverizers (e.g., cutter jet), both of which using jet stream. For example, a collision-type airflow pulverizer is configured to convey a material to be pulverized with a high-pressure gas such as jet stream and inject it from an outlet of an accelerating tube toward a collision member provided facing an aperture surface of the outlet of the accelerating tube. The material is pulverized by the impact force of the collision.

In a case in which a small-size toner is produced using the above collision-type airflow pulverizer, a large amount of air is required and therefore a large amount of electricity is consumed. This is disadvantageous from the viewpoint of energy cost.

Additionally, in a case in which a toner with a volume average particle diameter of 6 μm or less is produced using the above collision-type airflow pulverizer, a material to be pulverized is excessively pulverized and a larger amount of fine particles are produced. The excessive fine particles are required to be removed in a succeeding classification process so as not to degrade classification yield, i.e., toner productivity.

On the other hand, Japanese Patent No. 3870032, Japanese Patent Application Publication No. (hereinafter "JP-A") 2007-178718, and JP-A 2008-225317 each disclose mechanical pulverizers which are more advantageous than the above-described airflow pulverizers using jet stream from the viewpoint of energy consumption.

A mechanical pulverizer is configured to pulverize a material to be pulverized by introducing it to a circular space formed between a rotor that rotates at high speed and a stator that is disposed surrounding the rotor. Accordingly, the mechanical pulverizer does not require a large amount of air.

Therefore, the mechanical pulverizer consumes an extremely small amount of electricity, which results in drastic energy saving compared to collision-type airflow pulverizers. Additionally, it is unlikely that material to be pulverized is excessively pulverized, which results in enhancement of classification yield. Enhancement of classification yield has been an important issue in the pulverization methods, as disclosed in JP-A 2004-057843.

Focusing on the shapes of toner particles, the collision-type airflow pulverizer produces irregular and angular toner particles, whereas the mechanical pulverizer produces rounded toner particles.

The shape of a toner particle depends on how the toner particle has been pulverized. In airflow pulverizers, pulverization is mostly performed by collision of a material to be pulverized with a collision member. In mechanical pulverizers, pulverization is mostly performed by collision of a material to be pulverized with walls of a stator and a rotor while passing through a narrow gap between the stator and the rotor rotating at high speed. In the latter case, it is likely that pulverization is performed more than once. Also, in the latter case, heat is generated due to the pulverization and the pulverized particles become rounded due to the heat.

In accordance with recent progress in image quality and image definition of copiers and printers, toners are severely demanded to provide better performance. Specifically, toners are demanded to have a smaller size and a narrower size distribution in which no coarse particles and a very small amount of fine particles are included.

To respond to such demands, what is called a closed-circuit pulverization-classification system has been employed in toner manufacturing processes. In the closed-circuit pulverization-classification system, particles which have been pulverized by a mechanical pulverizer are discharged from the pulverizer to a classifier to remove coarse particles, and the remaining particles are returned to the mechanical pulverizer again.

On the other hand, recent toners are small in size for the purpose of enhancing image quality and are including wax components for the purpose of improving fixing performance. Such toners are likely to accumulate within pipings of toner manufacturing equipments, a powder collecting apparatus, etc.

If accumulated toner particles are collapsed on the way of returning of coarse particles to the mechanical pulverizer, the amount of throughput in the mechanical pulverizer may instantaneously increase and therefore the coarse particles may be fed to the classifier. In this case, similarly, the amount of throughput in the classifier may instantaneously increase and therefore the coarse particles may not be returned to the mechanical pulverizer. Consequently, coarse particles may be immixed in the product toner.

Such an instantaneous increase of the amount of throughput in the mechanical pulverizer may make an impact on the inner temperature of the mechanical pulverizer. As a result, pulverization capacity may be unstable and the shape of resulting toner may vary. The accumulation and collapsing of toner particles may also cause interruption or breakdown of the mechanical pulverizer when the toner particles are fixedly adhered to the mechanical pulverizer by increase of the inner temperature.

To avoid accumulation of toner particles in toner manufacturing equipments, vibrators and knockers have been used. Vibrators and knockers can remove partial clogging of toner particles in a toner manufacturing system, however, cannot completely remove accumulation and collapsing in the toner manufacturing system. As a result, the amount of throughput of toner is unstable.

Vibrators and knockers also have concerns that cracks may be generated due to noise of vibration and metallic fatigue.

SUMMARY OF THE INVENTION

Accordingly, an object of the present invention is to provide an apparatus and a method for producing toner, which can reliably produce high performance toners while effectively preventing accumulation of toner particles within the apparatus and immixing coarse particles in the product.

Another object of the present invention is to provide an apparatus and a method for producing toner using a mechanical pulverizer, which can produce high performance toners with a smaller specific surface area, better fluidity, and better filling efficiency at low energy in good yield. Such toners need a less amount of fluidizer and provide good chargeability and transferability.

These and other objects of the present invention, either individually or in combinations thereof, as hereinafter will become more readily apparent can be attained by:

an apparatus for manufacturing toner comprising a pulverizer for pulverizing a material into particles, a classifier for classifying the particles by size, a discharging path for discharging the particles from the pulverizer to the classifier, a returning path for returning relatively coarse particles among the classified particles from the classifier to the pulverizer, and a handling unit for handling particles, provided on at least one of the discharging path and the returning path, wherein the handling unit comprises a mechanism for preventing accumulation of the particles using airflow;

the above apparatus in which the pulverizer is a mechanical pulverizer;

an method for manufacturing toner comprising pulverizing a material into particles in a pulverizer, discharging the particles from the pulverizer to a classifier via a discharging path, classifying the particles by size in the classifier, and returning relatively coarse particles among the classified particles from the classifier to the pulverizer, wherein a handling unit for handling particles is provided on at least one of the discharging path and the returning path, and wherein the handling unit comprises a mechanism for preventing accumulation of the particles using airflow; and the above method in which the pulverizer is a mechanical pulverizer.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
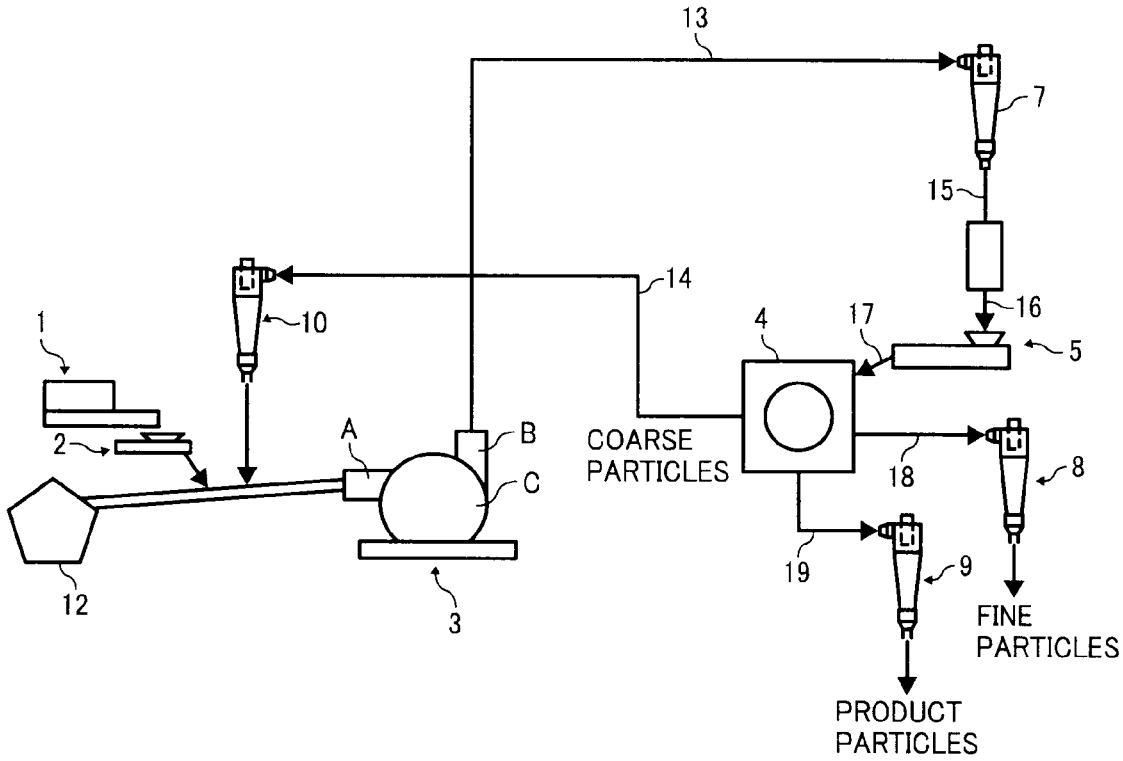
FIG. 1 is a schematic view illustrating an embodiment of a toner manufacturing system according to the present invention.

Exemplary embodiments of the present invention are described below with reference to the accompanying drawings. FIG. 1 is a schematic view illustrating an embodiment of the present invention, which is a toner manufacturing system employing a closed-circuit comprised of a typical mechanical pulverizer and a multi-segment classifier that performs classification using the Coanda effect.

First, toner components are kneaded and coarsely pulverized into particles (hereinafter "coarsely-pulverized particles"). Referring to FIG. 1, the coarsely-pulverized particles are supplied from a volumetric feeder 1 to an ejector-type feeder 2 and fed to a mechanical pulverizer 3 along with a compressed air. The mechanical pulverizer 3 is equipped with a cold air generator 12 so as to prevent heat generation caused by pulverization. The cold air generator 12 can control the mechanical pulverizer 3 to have an inlet temperature of from −10 and −5° C. The coarsely-pulverized particles are pulverized into smaller particles (hereinafter "finely-pulverized particles") in the mechanical pulverizer 3, and fed to a powder collector 7 via a discharging path 13. The finely-pulverized particles are then fed from the powder collector 7 to a classifier 4 by a volumetric feeder 5. The finely-pulverized particles are classified into "fine particles", "product particles" and "coarse particles" in the classifier 4. The fine particles are fed to a powder collector 8 and the product particles are fed to a powder collector 9. The coarse particles are fed to a powder collector 10 provided on a downstream site of a returning path 14, and then re-fed to the mechanical pulverizer 3 again along with coarsely-pulverized particles which are newly supplied from the ejector-type feeder 2.

Figure 2:
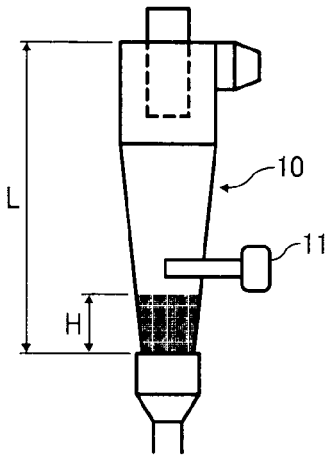
FIG. 2 is a schematic magnified view of the powder collector illustrated in FIG. 1.

FIG. 2 is a schematic magnified view of the powder collector 10. As illustrated in FIG. 2, the powder collector 10 is equipped with a powder sensor 11 for monitoring accumulation of toner particles (hereinafter "toner accumulation").

In FIG. 1, numerals 15, 16, 17, 18, and 19 each denote a path for passing toner particles.

The mechanical pulverizer 3 is equipped with an inlet air thermometer A, an outlet air thermometer B, and a motor electricity measuring instrument C for monitoring pulverization state.

The toner manufacturing system illustrated in FIG. 1 continuously produces toner particles (including "fine particles", "product particles" and "coarse particles") as described above. Toner particles are dispersed in air and moving within pipings which are connecting with each apparatuses.

Since the air containing toner particles flows fast within the pipings, toner particles are unlikely to accumulate therein. However, at lower parts of the powder collectors 7 to 10, toner particles are likely to accumulate because the toner particles and the air are separated temporarily. In a case in which toner particles are accumulated in the powder collector 10 that is provided on the returning path 14 for returning coarse particles to the mechanical pulverizer 3, an amount of coarse particles to be re-supplied to the mechanical pulverizer 3 is directly influenced because no volumetric feeder is provided to the powder collector 10.

To solve the above problem, a mechanism for preventing toner accumulation, such as a fluidized bed, may be provided to the powder collector 10. By preventing the toner accumulation, instantaneous increase of the throughput of the mechanical pulverizer 3 can be prevented. Such a mechanism for preventing toner accumulation can also be provided to the powder collectors 7, 8, and 9.

The fluidized bed may be a sintered metal, for example. Preferably, the sintered metal is in a form of a multi-layered sintered metal filter in which multiple typical stainless steels are laminated, for example. The sintered metal preferably has an opening of from 2.0 μm to 5.0 μm, more preferably from 3.0 μm to 5.0 μm, but it depends on the particle size distribution of toner particles, processing speed, and other manufacturing conditions. When the opening is 5.0 μm or more, recent small-size toner particles may pass through the opening. When the opening is 2.0 μm or less, toner particles may be adhered to the surface of the sintered metal and clogged in the opening.

The amount of air supplied from the fluidized bed, in other words, air supplying pressure of the fluidized bed, is determined depending on the capability of preventing toner accumulation of the fluidized bed. When the amount of air is too large, a problem may arise that the temperature of the cold air supplied from the inlet of the mechanical pulverizer 3 is increased. Specifically, the air supplying pressure is preferably from 0.1 to 0.3 MPa, and more preferably from 0.15 MPa to 0.25 MPa. When the air supplying pressure is too small, toner accumulation cannot be effectively prevented. When the air supplying pressure is too large, the temperature at the inlet of the mechanical pulverizer 3 is increased.

Referring to FIG. 2, the installation ratio of the fluidized bed in the powder collector 10 is defined by the ratio of the height H of the fluidized bed to the length L of the powder collector 10. Because the function of the fluidized bed is to prevent toner accumulation at areas in which toner particles actually accumulate, the fluidized bed is provided on a lower part of the powder collector 10. When the ratio (H/L) is 1/5 or less, toner accumulation is not sufficiently prevented. When the ratio (H/L) is 1/3 or more, the amount of air supplied from the fluidized bed increases, which results in increase of the inlet temperature of the mechanical pulverizer 3.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A mixture including 75% by weight of a polyester resin, 10% by weight of a styrene-acrylic resin, 10% by weight of a carbon black (i.e., a colorant), 7% by weight of a carnauba wax (i.e., a release agent), and 1% by weight of a quaternary ammonium salt (i.e., a charge controlling agent) was melt-kneaded using a roll mill. The kneaded mixture was cooled to be solidified. The solidified mixture was coarsely pulverized using a hammer mill.

The coarsely-pulverized particles were supplied from the volumetric feeder 1 of the toner manufacturing system illustrated in FIG. 1 at a throughput of 150 kg/h. Thus, a toner having an average particle diameter of 8.5 μm was prepared.

A fluidized bed made of a sintered metal was provided to the powder collector 10 to prevent toner accumulation. The setting and operating conditions of the fluidized bed were as follows; the opening was 2.0 μm, the air supplying pressure was 0.2 MPa, and the installation ratio (H/L) was 1/4.

The toner manufacturing system was put into operation for 3 hours and sample toner particles were taken and subjected to measurement of particle diameter every 10 minutes. The particle diameter of toner was measured using a MULTISIZER from Beckman Coulter.

As a result of the 3-hour operation, no accumulation was observed at a lower part of the powder collector 10, and the standard deviation of the content rate of particles having a diameter of 20 μm or more was 0.023, which means reliable toner production.

Comparative Example 1

The procedure in Example 1 was repeated except that the fluidized bed was not provided to the powder collector 10. As a result, the powder sensor 11 that was provided to the powder collector 10 detects toner accumulation at a lower part of the powder collector 10 in 30 minutes. As a result, the lower part of the powder collector 10 was clogged.

Example 2

The procedure in Example 1 was repeated except that the setting and operating conditions of the fluidized bed were changed as follows; the opening was 5.0 μm, the air supplying pressure was 0.3 MPa, and the installation ratio (H/L) was 1/3.

As a result of the 3-hour operation, a lower part of the powder collector 10 was not clogged, and the standard deviation of the content rate of particles having a diameter of 20 μm or more was 0.011, which means reliable toner production.

Example 3

The procedure in Example 1 was repeated except that the setting and operating conditions of the fluidized bed were changed as follows; the opening was 2.0 μm, the air supplying pressure was 0.1 MPa, and the installation ratio (H/L) was 1/5.

As a result of the 3-hour operation, a lower part of the powder collector 10 was not clogged, and the standard deviation of the content rate of particles having a diameter of 20 μm or more was 0.015, which means reliable toner production.

Example 4

The procedure in Example 1 was repeated except that the mechanical pulverizer 3 was replaced with an airflow pulverizer.

The setting and operating conditions of the fluidized bed were as follows; the opening was 2.0 μm, the air supplying pressure was 0.2 MPa, and the installation ratio (H/L) was 1/4, which was the same as Example 1.

As a result of the 3-hour operation, a lower part of the powder collector 10 was not clogged, and the standard deviation of the content rate of particles having a diameter of 20 μm or more was 0.019, which means reliable toner production.

Comparative Example 2

The procedure in Example 1 was repeated except that the fluidized bed was replaced with a vibrator.

As a result of the 3-hour operation, a lower part of the powder collector 10 was not clogged, but the standard deviation of the content rate of particles having a diameter of 20 μm or more was 0.369, which means unreliable toner production. Additionally, the degree of noise increased from 80 dB to 90 dB due to the operation of the vibrator.

Comparative Example 3

The procedure in Example 1 was repeated except that the fluidized bed was replaced with 2 knockers.

As a result of the 3-hour operation, a lower part of the powder collector 10 was not clogged, but the standard deviation of the content rate of particles having a diameter of 20 μm or more was 0.313, which means unreliable toner production. Additionally, the degree of noise increased from 80 dB to 95 dB due to the operation of the knocker.

Example 5

The procedure in Example 1 was repeated except that the opening of the fluidized bed was changed to 7.0 μm.

As a result of the 3-hour operation, a lower part of the powder collector 10 was not clogged, but the standard deviation of the content rate of particles having a diameter of 20 μm or more was 0.227, which means unreliable toner production.

Example 6

The procedure in Example 1 was repeated except that the air supplying pressure from the fluidized bed was changed to 0.4 MPa.

As a result of the 3-hour operation, a lower part of the powder collector 10 was not clogged, and the standard deviation of the content rate of particles having a diameter of 20 μm or more was 0.010, which means reliable toner production. However, the outlet temperature of the mechanical pulverizer 3 was increased because the amount of air supplied form the fluidized bed was increased.

Comparative Example 4

The procedure in Example 4 was repeated except that no mechanism for preventing toner accumulation was provided to the powder collector 10.

As a result, a lower part of the powder collector 10 was clogged in 20 minutes.

The results are shown in Tables 1 to 4.

TABLE 1

| | Pulverizer Type | Toner Accumulation Prevention Mechanism | Fluidized Bed Conditions | | |
|---|---|---|---|---|---|
| | | | Opening (μm) | Air Supplying Pressure (MPa) | Instal-lation Ratio (H/L) |
| Ex. 1 | Mechanical | Sintered Metal | 2.0 | 0.2 | 1/4 |
| Ex. 2 | Mechanical | Sintered Metal | 5.0 | 0.3 | 1/3 |
| Ex. 3 | Mechanical | Sintered Metal | 2.0 | 0.1 | 1/5 |
| Ex. 4 | Airflow | Sintered Metal | 2.0 | 0.2 | 1/4 |
| Ex. 5 | Mechanical | Sintered Metal | 7.0 | 0.2 | 1/4 |
| Ex. 6 | Mechanical | Sintered Metal | 2.0 | 0.4 | 1/4 |
| Comp. Ex. 1 | Mechanical | None | — | — | — |
| Comp. Ex. 2 | Mechanical | Vibrator | — | — | 1 point |
| Comp. Ex. 3 | Mechanical | Knocker | — | — | 2 points |
| Comp. Ex. 4 | Airflow | None | — | — | — |

TABLE 2

| | Occurrence of Clogging in | Electricity of Pulverizer | | Outlet Temperature of Pulverizer (° C.) | | |
|---|---|---|---|---|---|---|
| | Powder Collector | Max. | Min. | Max. | Min. | Δt |
| Ex. 1 | None | 41 | 31 | 42 | 40 | 2 |
| Ex. 2 | None | 42 | 32 | 43 | 42 | 1 |
| Ex. 3 | None | 41 | 32 | 41 | 40 | 1 |
| Ex. 4 | None | — | — | — | — | — |
| Ex. 5 | None | 58 | 30 | 46 | 41 | 5 |
| Ex. 6 | None | 46 | 32 | 49 | 44 | 5 |
| Comp. Ex. 1 | In 30 minutes | Unmeasurable due to clogging in powder collector | | | | |
| Comp. Ex. 2 | None | 45 | 31 | 44 | 40 | 4 |
| Comp. Ex. 3 | None | 47 | 30 | 43 | 39 | 4 |
| Comp. Ex. 4 | In 20 minutes | Unmeasurable due to clogging in powder collector | | | | |

* The electricity and outlet temperature were detected by a logger every 10 seconds.

TABLE 3

| | Volume Average | Content Rate of Particles with Particle Diameter of 20 μm or more (% by number) | | |
|---|---|---|---|---|
| | Particle Diameter (μm) | Max. | Min. | Standard Deviation |
| Ex. 1 | 8.5-8.7 | 0.11 | 0.02 | 0.023 |
| Ex. 2 | 8.5-8.6 | 0.06 | 0.02 | 0.011 |
| Ex. 3 | 8.4-8.5 | 0.07 | 0.00 | 0.015 |
| Ex. 4 | 8.5-8.7 | 0.07 | 0.01 | 0.019 |
| Ex. 5 | 8.4-8.9 | 0.76 | 0.02 | 0.227 |
| Ex. 6 | 8.4-8.7 | 0.06 | 0.03 | 0.010 |
| Comp. Ex. 1 | Unmeasurable due to clogging in powder collector | | | |
| Comp. Ex. 2 | 8.3-9.1 | 1.25 | 0.02 | 0.369 |
| Comp. Ex. 3 | 8.4-9.0 | 0.98 | 0.01 | 0.313 |
| Comp. Ex. 4 | Unmeasurable due to clogging in powder collector | | | |

TABLE 4-1

| Operation Time | Content Rate of Particles with Particle Diameter of 20 μm or more (% by number) | | | | | |
|---|---|---|---|---|---|---|
| (min) | Ex. 1 | Ex. 2 | Ex. 3 | Ex. 4 | Ex. 5 | Ex. 6 |
| 10 | 0.03 | 0.02 | 0.04 | 0.03 | 0.08 | 0.02 |
| 20 | 0.03 | 0.02 | 0.03 | 0.03 | 0.15 | 0.03 |
| 30 | 0.06 | 0.03 | 0.03 | 0.04 | 0.02 | 0.03 |
| 40 | 0.02 | 0.03 | 0.04 | 0.02 | 0.54 | 0.04 |
| 50 | 0.02 | 0.02 | 0.02 | 0.02 | 0.12 | 0.02 |
| 60 | 0.03 | 0.03 | 0.02 | 0.03 | 0.11 | 0.02 |
| 70 | 0.04 | 0.05 | 0.00 | 0.02 | 0.76 | 0.02 |
| 80 | 0.08 | 0.06 | 0.03 | 0.01 | 0.02 | 0.03 |
| 90 | 0.04 | 0.03 | 0.03 | 0.01 | 0.63 | 0.06 |
| 100 | 0.03 | 0.04 | 0.03 | 0.03 | 0.09 | 0.03 |
| 110 | 0.03 | 0.03 | 0.02 | 0.08 | 0.54 | 0.03 |
| 120 | 0.02 | 0.03 | 0.02 | 0.02 | 0.34 | 0.03 |
| 130 | 0.03 | 0.03 | 0.03 | 0.02 | 0.15 | 0.03 |
| 140 | 0.03 | 0.04 | 0.04 | 0.02 | 0.17 | 0.02 |
| 150 | 0.04 | 0.02 | 0.06 | 0.07 | 0.22 | 0.03 |
| 160 | 0.11 | 0.04 | 0.03 | 0.03 | 0.43 | 0.04 |
| 170 | 0.03 | 0.03 | 0.03 | 0.03 | 0.07 | 0.04 |
| 180 | 0.03 | 0.04 | 0.07 | 0.05 | 0.17 | 0.03 |
| STD | 0.023 | 0.011 | 0.015 | 0.019 | 0.227 | 0.010 |
| Average | 0.039 | 0.033 | 0.032 | 0.031 | 0.256 | 0.031 |

TABLE 4-2

| Operation | Content Rate of Particles with Particle Diameter of 20 μm or more (% by number) | | | |
|---|---|---|---|---|
| Time (min) | Comp. Ex. 1 | Comp. Ex. 2 | Comp. Ex. 3 | Comp. Ex. 4 |
| 10 | Unmeasurable due to clogging in powder collector | 0.18 | 0.08 | Unmeasurable due to clogging in powder collector |
| 20 | | 1.10 | 0.12 | |
| 30 | | 0.12 | 0.03 | |
| 40 | | 0.03 | 0.09 | |
| 50 | | 0.04 | 0.87 | |
| 60 | | 0.02 | 0.42 | |
| 70 | | 0.09 | 0.02 | |
| 80 | | 0.08 | 0.09 | |
| 90 | | 0.02 | 0.11 | |
| 100 | | 0.43 | 0.15 | |
| 110 | | 0.03 | 0.09 | |
| 120 | | 1.25 | 0.01 | |
| 130 | | 0.04 | 0.01 | |
| 140 | | 0.05 | 0.78 | |
| 150 | | 0.52 | 0.31 | |
| 160 | | 0.11 | 0.04 | |
| 170 | | 0.06 | 0.98 | |

TABLE 4-2-continued

| Operation | Content Rate of Particles with Particle Diameter of 20 μm or more (% by number) | | | |
|---|---|---|---|---|
| Time (min) | Comp. Ex. 1 | Comp. Ex. 2 | Comp. Ex. 3 | Comp. Ex. 4 |
| 180 | | 0.09 | 0.09 | |
| STD | | 0.369 | 0.313 | |
| Average | | 0.237 | 0.238 | |

This document claims priority and contains subject matter related to Japanese Patent Application No. 2009-001429 filed on Jan. 7, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An apparatus for manufacturing toner, comprising:

a pulverizer for pulverizing a toner material into particles;

a classifier for classifying the particles by size;

a discharging path for discharging the particles from the pulverizer to the classifier;

a returning path for returning relatively coarse particles among the classified particles from the classifier to the pulverizer;

a final toner path for discharging the toner from the classifier; and a handling unit for handling particles, provided on at least one of the discharging path and the returning path, the handling unit is a powder collector which includes a fluidized bed with a ratio (H/L) of a height (H) of the fluidized bed to a length (L) of the powder collector from ⅓ to ⅕.

2. The apparatus for manufacturing toner according to claim 1, wherein the handling unit is provided on the returning path.

3. The apparatus for manufacturing toner according to claim 1, wherein the fluidized bed has an opening of from 2 to 5 μm.

4. The apparatus for manufacturing toner according to claim 1, wherein the fluidized bed supplies air at a pressure of from 0.1 to 0.3 MPa.

5. The apparatus for manufacturing toner according to claim 1, wherein the pulverizer is a mechanical pulverizer.

6. A method for manufacturing toner, comprising:

pulverizing a toner material into particles in a pulverizer;

discharging the particles from the pulverizer to a classifier via a discharging path;

classifying the particles by size in the classifier;

discharging the toner from the classifier; and returning relatively coarse particles among the classified particles from the classifier to the pulverizer, wherein a handling unit for handling particles is provided on at least one of the discharging path and the returning path, and wherein the handling unit is a powder collector that includes a fluidized bed with a ratio (H/L) of a height (H) of the fluidized bed to a length (L) of the powder collector from ⅓ to ⅕.

7. The method for manufacturing toner according to claim 6, wherein the handling unit is provided on the returning path.

8. The method for manufacturing toner according to claim 6, wherein the fluidized bed has an opening of from 2 to 5 μm.

9. The method for manufacturing toner according to claim 6, wherein the fluidized bed supplies air at a pressure of from 0.1 to 0.3 MPa.

10. The method for manufacturing toner according to claim 6, wherein the pulverizer is a mechanical pulverizer.

* * * * *